United States Patent [19]

Gollnick

[11] 4,050,594

[45] Sept. 27, 1977

[54] REFUSE LOADING APPARATUS

[75] Inventor: Cyril R. Gollnick, Oshkosh, Wis.

[73] Assignee: Leach Company, Oshkosh, Wis.

[21] Appl. No.: 623,605

[22] Filed: Oct. 20, 1975

[51] Int. Cl.[2] ..... B65F 3/00

[52] U.S. Cl. ..... 214/83.3

[58] Field of Search ..... 214/83.3, 503; 100/245

[56] References Cited

U.S. PATENT DOCUMENTS

| | | | |
|---|---|---|---|
| 3,092,269 | 6/1963 | Brown et al. | 214/83.3 |
| 3,746,192 | 7/1973 | Herpich et al. | 214/83.3 |

*Primary Examiner*—Robert G. Sheridan

*Attorney, Agent, or Firm*—Lockwood, Dewey, Zickert & Alex

[57] ABSTRACT

A refuse loading apparatus for use in the hopper of a tailgate loading assembly at the rear of a vehicle having a refuse storage body. The packer plate is powered by a hydraulic actuation system including a first pair of hydraulic cylinders which cause rearward and forward motion of the packer plate, and a second pair of hydraulic cylinders which cause elevational movement of the packer plate in the hopper. The packer plate is guided and restrained in its movement by the interior parameters of the hopper and the limits of the hydraulic cylinder movement. The pairs of hydraulic cylinders are interconnected through the hydraulic actuator system such that when the hydraulic cylinders are fully extended, or when the packer plate contacts an obstruction, whether it be the parameters of the hopper or refuse which it cannot move through the hopper, the packer plate changes direction and moves toward completion of a cycle through the hopper. The packer plate will automatically move over any obstruction which it cannot push through the hopper so that an operator can remove the obstruction or condition it such that the packer plate will move it through the hopper and into the storage body.

4 Claims, 9 Drawing Figures

FIG. 1
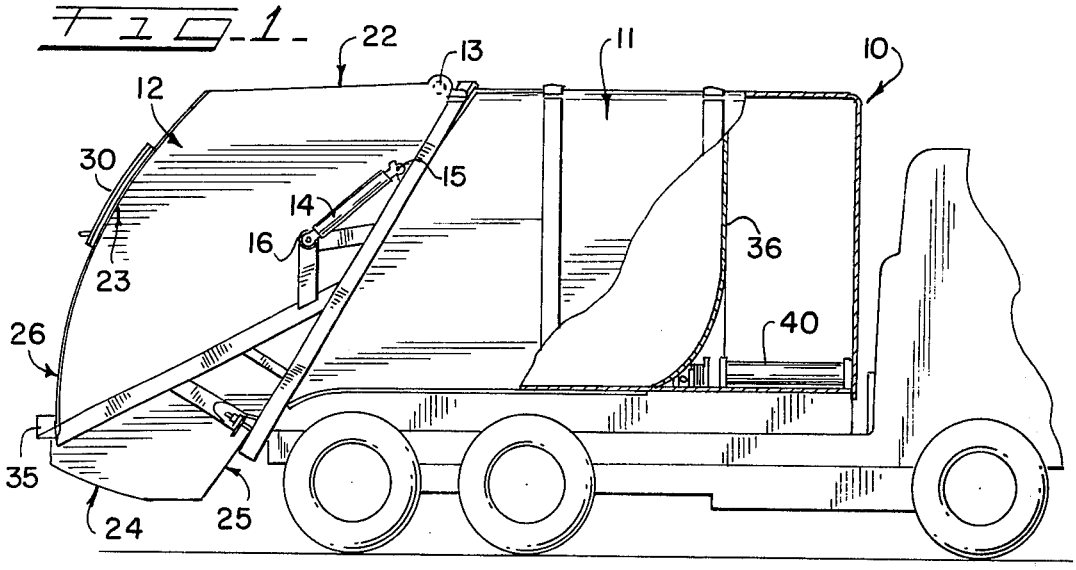
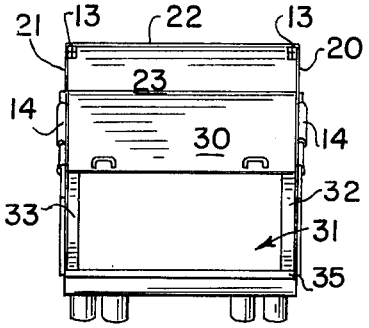
FIG. 2
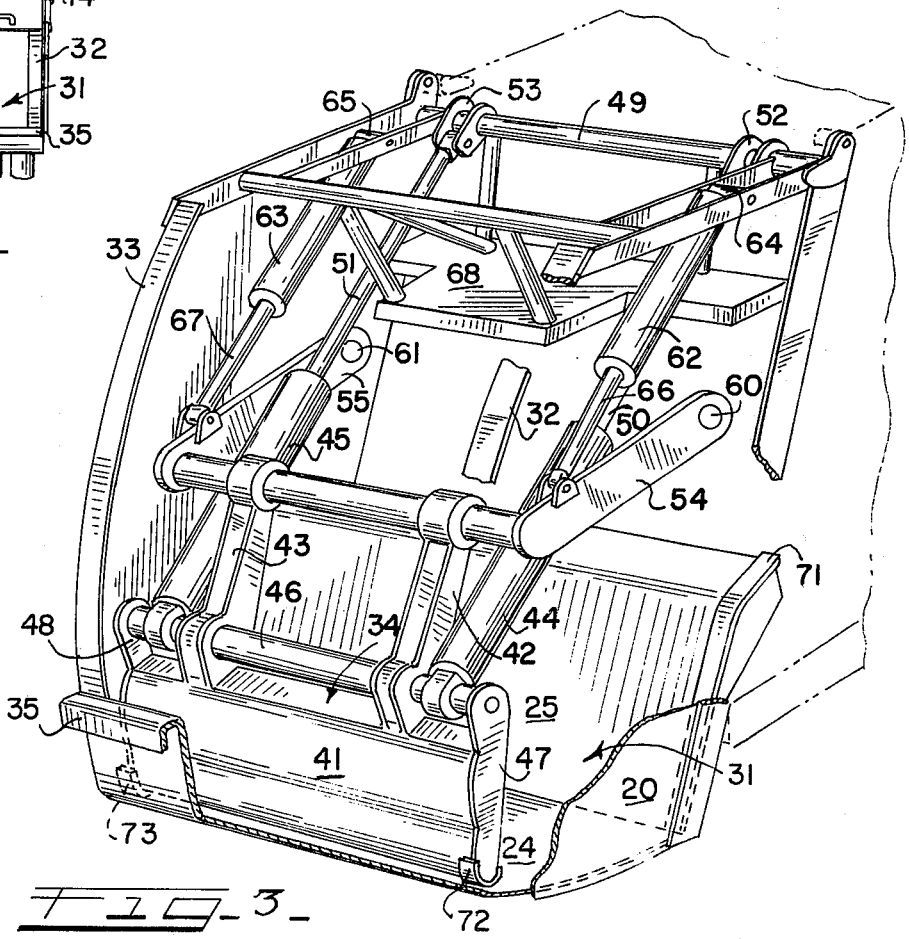
FIG. 3

REFUSE LOADING APPARATUS

BACKGROUND OF THE INVENTION

This invention relates in general to refuse collection and transport vehicles, and more particularly to an improved refuse loading apparatus, including means for controlling the movement of the apparatus, in such vehicles.

Apparatus for loading refuse and garbage into the body of a refuse collecting and transporting vehicle generally employ a hopper attached to the rear of the body into which refuse is dumped by hand. A packer plate is mounted in the hopper so as to move cyclically through it to compact and push refuse placed therein forward from the hopper toward the front of the vehicle body. The hopper is typically formed by a pair spaced-apart side plates and a contoured bottom plate. The packer plate is typically mounted within the hopper by connecting linkage and driven over an operating path by means of a hydraulic actuator system which may include one or more pairs of hydraulic cylinders.

Heretofore, in performing the packing operation, the bottom edge of the packer plate has been guided in close association with the bottom of the hopper during the packing portion of its operating cycle by means of cams or bearing surfaces mounted on the sides of the packer plate, and by opposed guide channels or cam tracks provided on the inside surfaces of the side plates of the hopper housing in which the cams ride. Such apparatus is shown and described in U.S. Pat. Nos. 3,653,522; 3,739,927; and 3,874,529; by me and assigned to the assignee of the present application. Use of such guide channels or cam tracks require the packer plate to travel along a rigidly defined operating path which sweeps from the back of the hopper to the front in close proximity to the floor of the hopper. Problems may occur with the packer plate when refuse or garbage becomes an obstruction which does not fit entirely into the hopper or which when positioned in the hopper cannot be moved into the vehicle body by the normal operating sweep of the packer plate. This problem is especially significant when the operation of the packer plate is controlled by automatic apparatus, typically including hydraulic circuitry. Either complex overload compensating circuitry has been utilized, or additional circuitry for manual operation must be provided to retract the packer plate to a position where operators may remove the obstruction from the hopper.

SUMMARY OF THE INVENTION

The invention is directed, in a refuse collection and transport vehicle of the type having a refuse storage body and a hopper for receiving refuse to be loaded therein, to a loading apparatus for transporting batches of refuse from the hopper to the storage body. The loading apparatus comprises means including a packer plate for removing refuse from the hopper, and actuating means including means for controlling the vertical position of the packer plate in the hopper. The actuating means urges the packer plate on an operating path wherein the packer plate is guided along the interior parameters of the hopper so as to scoop batches or refuse contained therein into the storage body. The urging means is dominant over the vertical control means and causes the packer plate to move over any restriction in its path of travel by overcoming the actuation and reversing the movement of the vertical control means when the actuation of the urging means is restricted.

BRIEF DESCRIPTION OF THE DRAWINGS

The features of the present invention, which are believed to be novel, are set forth with particularity in the appended claims. The invention together with further objects and advantages thereof, may best be understood by reference to the following description taken in connection with the accompanying drawings in the several figures of which like reference numerals identify like elements, and in which:

FIG. 1 is a side elevational view of a refuse receiving and transportation vehicle incorporating the refuse loading apparatus constructed in accordance with the invention;

FIG. 2 is a rear elevational view of the refuse receiving and transporting vehicle of FIG. 1.

FIG. 3 is a skeletal perspective view partially cut away of a portion of the refuse receiving and transporting vehicle showing the primary components of the refuse loading apparatus of the invention;

DESCRIPTION OF THE PREFERRED EMBODIMENT

Figure 4:
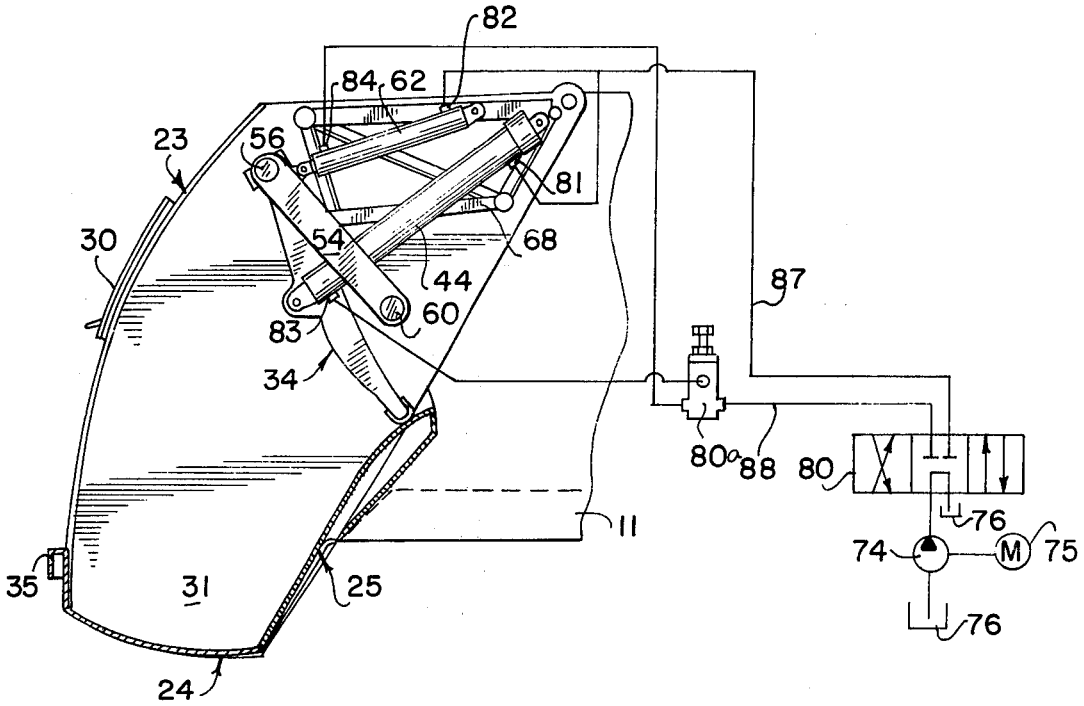
FIG. 4 is a side elevational view of the refuse loading apparatus showing its components in a first portion of the loading cycle.

As shown in FIGS. 1 and 2, a refuse vehicle 10 incorporating a refuse loading apparatus constructed in accordance with the invention may be conventional in design and construction. Such a vehicle includes a large capacity storage body 11 of horizontally elongated generally rectangular cross-section which is closed at its rear end by generally rectangular tailgate housing 12 having a curved back and a curved bottom side which extends below the bottom of the storage body. The tailgate housing is pivotally connected at the front of its upper surface to the upper edge of the rear end of the storage body at pivotal mountings 13—13. A pair of hydraulic cylinders 14—14, one positioned on each side of refuse vehicle 10, with one end pivotally mounted to the rear side edge of storage body 11 at 15 and its other end pivotally mounted to the side of the tailgate housing 12 at 16, when extended enable the housing to be swung rearwardly and upwardly into an out-of-the-way position for unloading the body.

The tailgate housing 12 is characterized by vertical sidewalls 20 and 21, a generally flat top wall 22, a downwardly and rearwardly sloping rear wall 23, an arcuately curved botton wall 24, and an upwardly sloping front wall 25.

The front wall 25, does not enclose the housing, but extends transversely thereacross from the bottom wall 24 to a position slightly above the bottom of storage body 11. Likewise, an opening 26 transversely extends across the middle of back wall 23 and is adapted to be closed when not in use by an upwardly and downwardly movable door 30. Opening 26 defines the rear and top most portions of a refuse-receiving portion or hopper 31 into which batches of loose refuse or garbage are initially dumped through the opening 26. Opening 26 has margins spaced inwardly at either side of sidewalls 20 and 21 or back angles 32 and 33 for the purpose of guiding the packing plate 34 as it moves across opening 18 as will be seen presently. A sill 35 positioned at a convenient height is provided at the bottom of opening 26 resting garbage cans and other refuse containers on it prior to dumping their contents into the hopper 31.

Referring to FIG. 3, the movable packing plate 34 is mounted within tailgate housing 12 for the purpose of transferring from hopper 31 into the storage body 11 refuse which has been dumped into the hopper through the opening 26. The refuse thus transferred is compacted within body 11 against an upwardly inclined slidably mounted compaction plate 36 (FIG. 1). Compaction plate 36, which may be positioned within storage body 11 by conventional means such as by a hydraulic cylinder and ratchet assembly 40, serves a dual function. It compresses the refuse loaded into the storage body 11 and pushes the compacted refuse out the rear of the storage body when tailgate housing 12 is pivoted upwardly by extending hydraulic cylinder 14—14.

Packing plate 34 comprises a blade portion 41 which extends transversely from one side of tailgate housing 12 to the other and a pair of upwardly projecting blade arms 42 and 43. The packer plate 34 is moved forwardly and rearwardly through the tailgate housing 12 by a pair of hydraulic cylinders 44 and 45, henceforth termed the packer cylinders. Packed cylinders 44 and 45 are pivotally connected to the packer plate 34 adjacent respective ends of a shaft 46 positioned through the bases of blade arms 42 and 43 in adjacent spatial relation to blade portion 41 and the actuator rods 50 and 51 of the cylinders are pivotally connected at mountings 52 and 53 on tubular frame 49 at the top of tailgate housing 12. Wear plates 47 and 48 are positioned at the sides of packing plate 34 and extend upward to cover the ends of shaft 46.

The upwardly projecting blade arms 42 and 43 of the packer plate 34 are pivotally connected inwardly adjacent the ends of a transversely extending torque tube 56, which extends between and is rigidly attached at its ends to the respective free ends of a pair of torsion or equalizing arms 54 and 55. The other ends of torsion arms 54 and 55 are pivotally connected to the housing sidewalls 20 and 21 at pivot points 60 and 61. The arcuate movement of torsion arms 54 and 55, which is largely vertical, is controlled by a pair of hydraulic cylinders 62 and 63, henceforth termed the height control cylinders. Height control cylinders 62 and 63 are pivotally connected at pivot points 64 and 65 to the respective ones of the housing sidewalls 20 and 21, and the actuator rods 66 and 67 of the cylinders are pivotally connected to the respective ones of the torsion arms 54 and 55 intermediate their ends. A refuse deflector plate 68 is rigidly maintained by tubular frame 49 in parallel spatial relationship below the top wall 22 of tailgate housing 12. Deflector plate 68 moves refuse coming in contact with the plate during the forward and upward packing motion of packer plate 34 and aides in compacting the refuse and urging it in a forward direction into the storage body 11 of the refuse collecting vehicle 10.

From the preceeding description it will be understood that the packer plate 34 is suspended within the tailgate housing 12 in a generally vertical position for both pivotal and transitory movement. The angular and elevational positions assumed by the blade portion 41 of the packer plate 34, in its cyclical movement are determined by (1) the suitable actuation of the packer cylinders 44 and 45 and height control cylinders 62 and 63, and (2) the restraint imposed on the movement of the packer plate by the inner parameters of the hopper 31. In order to lessen wear between the bottom of the packer plate blade portion 41 and the back and front inner surfaces or parameters of hopper 31, extensions of back angles 32 and 33 on the front sides of the hopper are provided at 71 (shown in FIG. 3 for one side only). Also, skid plates 72 and 73 are mounted at opposite sides of the packer blade and are contoured to cover the bottom corners of the packer blade to lessen wear as the packer plate is used cycle after cycle.

The actuation of packer cylinders 44 and 45 and height control cylinders 62 and 63 is controlled in a proper cyclical sequence by an automatic hydraulic actuator system. The actuator system utilizes not only the hydraulic pressure from the system itself to actuate the height control cylinders and packer cylinders in a proper sequence, but, also utilizes additional forces upon the hydraulic system generated by the packer plate 34 as it encounters the parameters of hopper 31 and also any immovable object which may be partially or wholely positioned within hopper 31.

Referring to FIGS. 4–9 a schematic of the hydraulic actuator system is shown along with a side elevational view of the refuse loading apparatus as it moves through succeeding portions of a single loading cycle. The hydraulic actuator system includes a hydraulic pump 74, which may be conventional in design and construction, and which may be powered by an electric motor 75, the vehicle engine, or other suitable means. Hydraulic oil is drawn by the pump 74 from a reservoir 76 and circulated by the pump through a three-position hydraulic control valve 80 and thence to the height control cylinders and packer cylinders to move the packer plate 34 through cyclic operation. The simplicity of the hydraulic actuator system is shown by the fact that the apparatus previously mentioned and a sequence valve 81, the function of which will be described below, comprise the entire actuator system.

Figure 5:
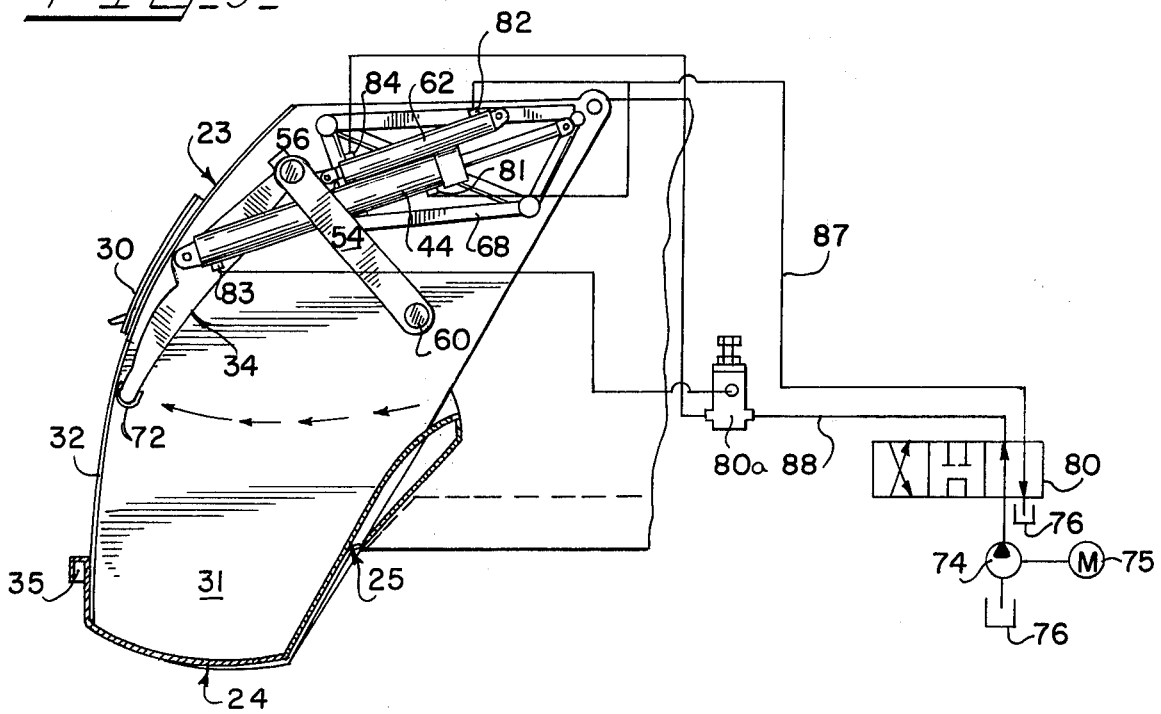
FIG. 5 is a side elevational view of the refuse loading apparatus showing its components in a second portion of the loading cycle.

Three-way control valve 80 automatically moves through a cycle of operation once the valve is moved from the neutral position of FIG. 4 to the first position of FIG. 5 by a hand lever (not shown). The control valve 80 is manufactured by the assignee of the present application and is sold under the name Leach Main Operating Valve. The automatic switching of the plunger in main operating valve 80 is performed by a combination hydraulic and mechanical means in the valve (not shown) which are activated by increased oil pressure in the actuation circuit which opens check valves in the various ports in control valve 80. Oil at increased pressure flowing through the check valve moves mechanical means which actuates the valve plunger through the respective operating sequence. While the Leach Main Operating Vavle 80 is old in the art, the increase in pressure used to automatically shift the valve plunger through the operating sequence is also utilized in the remainder of the hydraulic system actuation circuitry. The increased pressure switches the valve to change the direction of packer plate travel toward completion of its cycle when the packer plate is restricted in its backward extending movement, either by the interior parameters of the hopper, by reaching the limit of extension of the height control cylinders, or by refuse in the hopper which the packer plate cannot move into the storage body. When the packer plate is restricted in its forward or contracting movement, the packer cylinders overpower and reverse the movement of the height control cylinders to move the plate over the restriction. The automatic compensation movement of the packer plate will be discussed below as a sequence of operation of the packer plate is described in more detail.

It will be appreciated that while only the hydraulic circuitry associated with hydraulic cylinders 44 and 62 are shown in FIGS. 4–9 for the sake of clarity, in practice, hydraulic cylinders 45 and 63 will also be provided with hydraulic circuitry for controlling movement of the other side of the packer plate. This circuitry may be separate but identical to that for cylinders 44 and 62, or may be combined with the circuit for cylinders 45 and 63 to make common use of one or more components. Also, height control cylinders 62 and 63 are in a regenerative mode as they extend and retract. In the first sequence of operation, shown in FIG. 4, the packer plate 34 is maintained in a load-retaining position with its blade portion 41 positioned across the front opening of tailgate assembly 11 between refuse retaining plate 68 and the top most portion of the tailgate assembly front wall 25. In this load-retaining position, packer cylinder 44 and control cylinder 62 are maintained in non-extended positions because the upper ports 81 and 82 of the packer cylinder and height control cylinder respectively, and the lower ports 83 and 84 of the packer and height control cylinders respectively are plugged because control valve 80 is in a middle or neutral position where all hydraulic fluid flow is prevented.

It should be noted that the hydraulic circuitry between control valve 80 and the respective hydraulic cylinder ports is divided into two lines both having a Y configuration. The distal ends of the Y in the first line 87 are connected to the respective ones of the upper ports in the packer and height control cylinders. The second Y-line 88 includes sequence valve **80*a* at the juncture of the Y, with its distal ends connected to the lower ports 83 and 84 of the packer and height control cylinders respectively. The sequence valve 80*a* divides the Y-line into a primary and a secondary circuit. The primary circuit (from 80*a* to 84 in FIGS. 5 and 6) receives all pump output until system pressure reaches a predetermined point. Pump output, at that time, flows to the secondary circuit (80*a* to 83 in FIGS. 5 and 6) at the pressure setting of the primary circuit, but only so long as that pressure is maintained in the primary circuit. Any pressure rise in the secondary circuit is reflected back to the primary circuit. The basic purpose of sequence valve 80*a* is to insure a predetermined pressure in the primary circuit before the secondary circuit is energized. After the hopper 31 has been filled with refuse, the operator of the tailgate assembly moves a lever (not shown) positioning control valve 80 at its up or right side position as shown in FIG. 5. This causes hydraulic fluid to be pumped into the second Y-line 88 through sequence valve 80a to the lower ports 83 and 84 of the packer and height control cylinders respectively. Since the packer cylinder 44 is oriented to extend oppositely of control cylinder 62, the flow of oil through the second Y-line 88 to lower port 83 of packer cylinder 44 (secondary circuit) acts to extend the cylinder while the flow of fluid to the lower port 84 of control cylinder 62 (primary circuit) acts first to maintain that cylinder in contracted position with the contraction of height control cylinder 62 and subsequent extension of packer cylinder 44, packer plate 34 pivots backwardly or clockwise around torque tube 56 until the skid plate 72 at the bottom of blade portion 41 impinges the back angle 32**.

Figure 6:
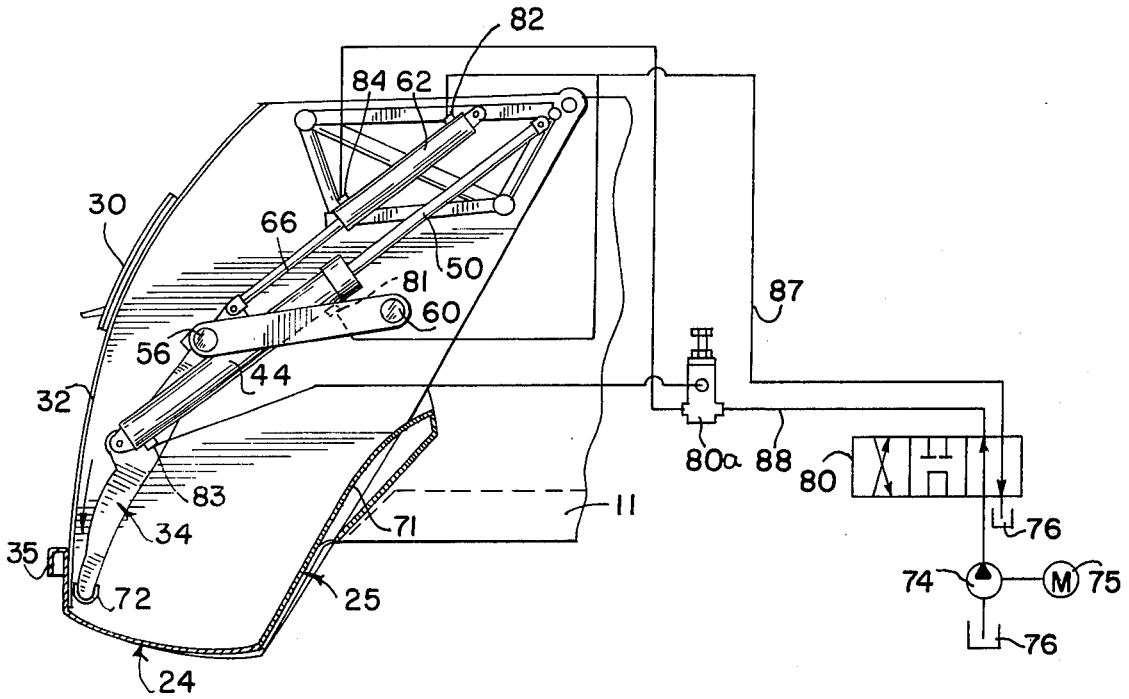
FIG. 6 is a side elevational view of the refuse loading apparatus showing its components in a third portion of the loading cycle.

Referring to FIG. 6, in the third sequence in a cycle of operation the packer plate 34 travels down the back angle 32 across the rear opening 26 in the tailgate assembly to its furthest extended position of travel. From sequence 2 in FIG. 5 to sequence 3 in FIG. 6 packer cylinder 44 continues its extension. Since the piston area in packer cylinder 44 is larger than the piston area in height control cylinder 62, the extending packer cylinder 44 acts through packer plate 34 and its arm 42 to overcome the resistance at the lower port 84 of control cylinder 62 and pulls the actuator rod 66 outwardly of control cylinder 62 until it reaches its limit of extension. The extension of both hydraulic cylinders causes torsion arm 54 to rotate counterclockwise (largely downward) about its pivot point 60. When height control cylinder 62 is at its limit of extension the bottom of the packer plate 34 is in spatial proximity to the bottom 24 of the tailgate housing 12.

Figure 7:
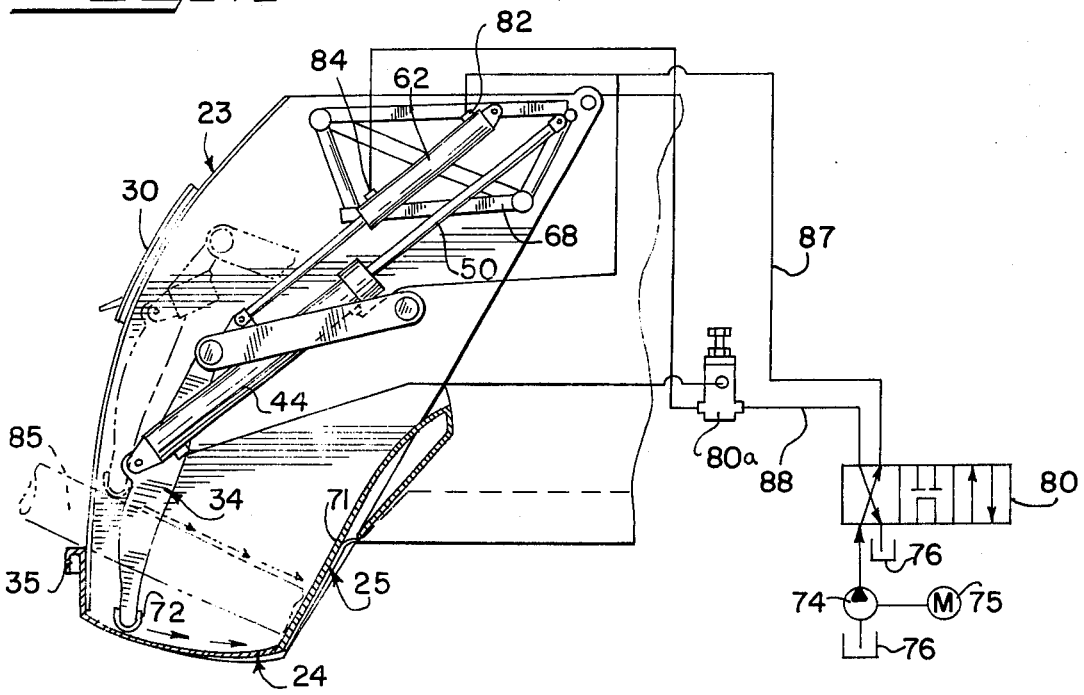
FIG. 7 is a side elevational view of the refuse loading apparatus showing its components automatically moving over the top of an obstruction which sticks out of the hopper.
Figure 8:
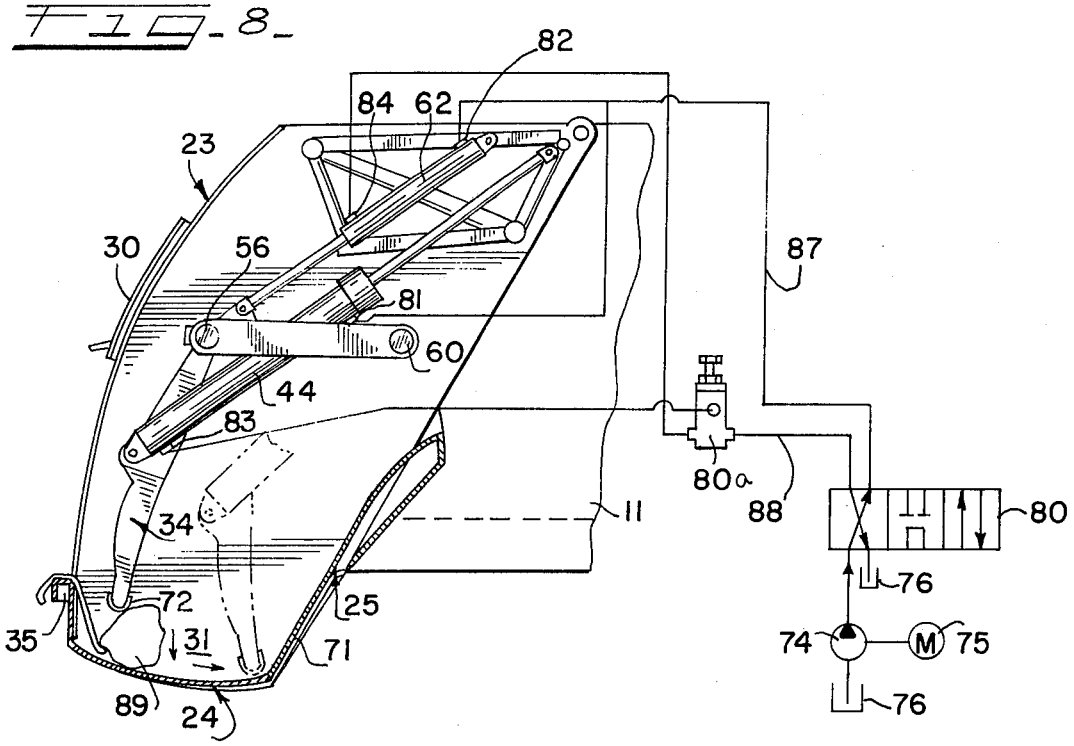
FIG. 8 is a side elevational view of the refuse loading apparatus showing its components automatically moving over the top of an immovable obstruction positioned in the hopper.

The fourth sequence in a cycle of operation of the packer plate 34 is its movement forward from the back angle 32 to the front sidewall 25 of the tailgate assembly 12 in close spatial relation to the bottom surface 25. This sequence in the movement of packer plate 34 is begun or triggered when packer plate 34 reaches the end of its travel downward along back angle 32. When the height control cylinder 62 can extend no further downward, pressure in the second Y-line 88 increases to the point where a check valve (not shown), in the part of control valve 80 through which second Y-line 88 is fed, opens and activates a reversing plunger (not shown) which shifts control valve 80 to the cross over or left side position as shown in FIG. 7. This pressure increase which causes automatic reverse shifting of the control valve 80 may take place not only when control cylinder 62 reaches its limit of extension, but it may also take place when the bottom of packer plate 34 makes contact with an immovable object 85, as shown in outline in FIG. 7.

The reversal of control valve 80 causes the hydraulic fluid to flow from pump 74 into the first Y-line 87 and to the upper ports 81 and 82 of the packer and height control cylinders 44 and 62, respectively. The flow of hydraulic fluid into upper port 82 of height control cylinder 62 maintains that cylinder in an extended position, and the flow of hydraulic fluid into upper port 81 of the packer cylinder 44 causes the packer plate 34 to move counterclockwise around torque tube 56 which moves the bottom end of packer plate 34 forward, either in close spatial relation to bottom wall 24, or along the top of the obstruction 85, until skid plate 72 contacts front angle 71 on the front surface 25 of hopper 31.

Another type of obstruction may be encountered by the packer plate travelling in the hopper 31. After control valve 80 has been reversed to its cross or left-most position and packer plate 34 has started moving toward the front of hopper 31, packer plate 34 may meet an obstruction 89 of the type which prevents its further forward movement. If such an obstruction is met, the larger piston area or packer cylinder 44 overcomes the resistance in smaller height control cylinder 62, and causes the packer plate 34 to pivot around its lower end thereby contracting height control cylinder 62. This contraction together with further contraction of packer cylinder 44 moves the packer plate up and over the immovable object 89. Once the packer plate 34 clears the obstruction 89, height control cylinder 62 again extends as oil is moving into upper port 82 and packer plate 34 is again moved downwardly until it contacts bottom surface 24 of the hopper 31. Packer cylinder 44 continues to contract as oil flows into its upper port 81, and therefore, the packer blade moves forwardly until skid plate 72 contacts forward angle 71 on front surface 25.

Figure 9:
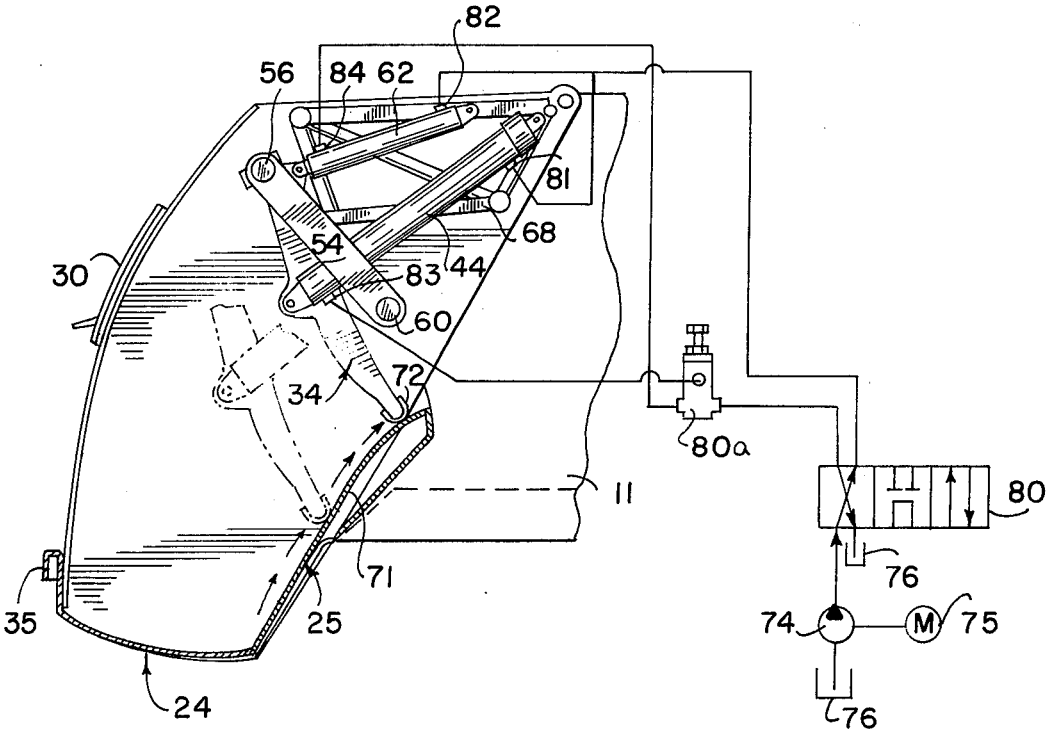
FIG. 9 is a side elevational view of the refuse loading apparatus showing its components completing the loading cycle and returning to the first or starting position.

The sixth and final sequence of a cycle of packer plate movement is shown in FIG. 9, wherein the packer plate 34 moves up the front side 25 of hopper 31. The hydraulic flow causing movement of the packer plate 34 up the front surface 25 is the same as that which causes the packer plate to move over the immovable object 89. The contraction of packer cylinder 44, due to its larger piston area, overcomes the pressure at port 82 in height control cylinder 62 to force the contraction of the cylinder 62 and thereby return the packer plate 34 to the neutral or starting sequence shown in FIG. 4. When the position of the starting sequence is achieved, the increased pressure in the first Y-line 87 causes a check valve (not shown) in the first Y-line port of control valve 80 to open which actuates a knock-out plunger (not shown) in the control valve 80 to return to its intermediate position, after which a new cycle may be started.

A significant advantage of the present invention is the relative simplicity of the hydraulic circuitry associated in the first and second Y-lines 87 and 88, respectively, and the capability of packer cylinder 44 being able to overcome the resistance provided by height control cylinder 62 thus allowing the packer plate 34 to deviate from a normal operating path when immovable objects are positioned in the hopper area 31 of tailgate assembly 12. Once the packer plate has moved over an immovable object, the object may be removed from the hopper and further conditioned or divided so as to enable it to be moved through the hopper 31 on a succeeding cycle of operation of the packer plate.

While one particular type of hydraulic circuit has been shown, it will be appreciated that other types of circuit arrangements can be used as well. Furthermore, the invention can be practiced with other types of linkages and cylinder arrangements and with other sizes and shapes of refuse hoppers.

While a particular embodiment of the invention has been shown and described, it will be obvious to those skilled in the art that changes and modifications may be made without departing from the invention in its broader aspects. Therefore the aim in the appended claims is to cover all such changes and modifications as fall within the true spirit and scope of the invention.

I claim:

1. In a refuse collection and transport vehicle of the type having a refuse storage body and a hopper for receiving refuse therein, loading apparatus for transporting batches of refuse from said hopper to said storage body, said loading apparatus including:

means including a packer plate positioned in said hopper for removing refuse therefrom, actuating means including means for supporting said packer plate in said hopper, said actuating means having means including a first hydraulic ram mounted in operative communication between said packer plate means and either one of said hopper and said storage body for controlling the vertical position of said packer plate in said hopper and means including a second hydraulic ram mounted in operative communication between said packer plate means and either one of said hopper and said storage body for urging said packer plate through said hopper;

said first hydraulic ram and said second hydraulic ram coacting to move said packer plate on an operating path therethrough so as to scoop batches of refuse contained therein into said storage body; and the improvement wherein said second hydraulic ram is dominant over said first hydraulic ram, said second hydraulic ram including means acting through said packer plate means for changing the movement of said first hydraulic ram against the direction of energised movement thereof, and said change in movement of said first hydraulic ram being capable of extending over a substantial portion of the total operative length of travel thereof.

2. The refuse collection and transport vehicle defined in claim 1 wherein said hopper is pivotally mounted to said storage body at a top rearmost portion thereof, and said first and second hydraulic rams are mounted in operative communication between said packer plate means and said hopper, whereby said hopper may be pivotally swung clear of a rear opening in said storage body when refuse is to be dumped from said storage body.

3. The refuse collection and transport vehicle defined in claim 1 wherein a port in said second hydraulic ram is in direct operative communication with a complementary port in said first hydraulic ram, said direct communication allowing the filling of a low pressure side of said first ram with hydraulic fluid as a piston thereof is pulled outwardly of said first ram against the energised movement thereof.

4. The refuse collection and transport vehicle defined in claim 3 wherein said direct operative communication further directs fluid flow from a high pressure side of said first ram as said piston thereof is forced inwardly of said first ram against the energised movement thereof.

* * * * *

UNITED STATES PATENT AND TRADEMARK OFFICE

CERTIFICATE OF CORRECTION

PATENT NO. : 4,050,594

DATED : September 27, 1977

INVENTOR(S) : Cyril Gollnick

It is certified that error appears in the above-identified patent and that said Letters Patent are hereby corrected as shown below:

Column 3, Line 1: "botton" should be--"bottom"--

Column 3, Line 41: "packed" should be--"packer"--

Column 5, Line 2: "Vavle" should be--"Valve"

Column 7, Line 8: "or" should be--"of"--

Signed and Sealed this

*Twenty-third* Day of *January 1979*

[SEAL]

*Attest:*

RUTH C. MASON
*Attesting Officer*

DONALD W. BANNER
*Commissioner of Patents and Trademarks*